US012390676B2

(12) United States Patent
Greenberg et al.

(10) Patent No.: US 12,390,676 B2
(45) Date of Patent: Aug. 19, 2025

(54) INTERACTIVE ELECTRONIC TRAMPOLINE

(71) Applicant: The Radio Flyer Company, Chicago, IL (US)

(72) Inventors: Daniel Greenberg, Chicago, IL (US); Samantha Sturgeon, Chicago, IL (US)

( * ) Notice: Subject to any disclaimer, the term of this patent is extended or adjusted under 35 U.S.C. 154(b) by 81 days.

(21) Appl. No.: 17/703,108

(22) Filed: Mar. 24, 2022

(65) Prior Publication Data

US 2022/0305319 A1 Sep. 29, 2022

Related U.S. Application Data

(60) Provisional application No. 63/165,512, filed on Mar. 24, 2021.

(51) Int. Cl.

| | |
|---|---|
| ***A63B 5/11*** | (2006.01) |
| ***A63B 71/00*** | (2006.01) |
| ***A63B 71/06*** | (2006.01) |

(52) U.S. Cl.

CPC ..... *A63B 5/11* (2013.01); *A63B 71/0054* (2013.01); *A63B 71/0622* (2013.01); *A63B 2071/0625* (2013.01); *A63B 2220/801* (2013.01); *A63B 2220/803* (2013.01); *A63B 2220/833* (2013.01)

(58) Field of Classification Search

None

See application file for complete search history.

(56) References Cited

U.S. PATENT DOCUMENTS

| | | | |
|---|---|---|---|
| 3,838,744 | A | 10/1974 | Tanji et al. |
| 3,853,191 | A | 12/1974 | Yamagiwa |
| 4,191,268 | A | 3/1980 | Miyoshi et al. |
| 4,516,767 | A | 5/1985 | Eskijian |
| 4,720,789 | A | 1/1988 | Hector et al. |
| 4,742,437 | A | 5/1988 | Downey |
| 4,924,743 | A | 5/1990 | Tsai |
| 5,141,065 | A | 8/1992 | Maxwell et al. |

(Continued)

FOREIGN PATENT DOCUMENTS

| | | | | |
|---|---|---|---|---|
| CN | 201079651 Y | * | 7/2008 | ..... A63B 5/11 |
| CN | 101433748 B | * | 3/2011 | |

(Continued)

OTHER PUBLICATIONS

"HearthSong Multi-Color LED Light-Up Kids' Trampoline for Indoor and Outdoor Active Play, 40" Diam. ×. 10" H, Holds up to 220 Lbs." available online at: shorturl.at/SX027 (available at least as early as Mar. 23, 2021) (5 pages).

(Continued)

*Primary Examiner* — Shila Jalalzadeh Abyaneh

(57) ABSTRACT

An interactive electronic trampoline assembly is made up of a frame, legs, a trampoline mat, a plurality of bias members to secure the trampoline mat to the frame, and a sensor to sense movement of the trampoline mat. A handlebar may also be connected to the frame. A control module may be removably secured to the assembly adjacent the frame. The control module may have a speaker, a power source, a controller, lights and control buttons. The sensor may also be housed in the control module. Different lights and sounds are output based on an input to the controller, the game being played and input received by the sensor.

15 Claims, 6 Drawing Sheets

(56) References Cited

U.S. PATENT DOCUMENTS

| | | | | | |
|---|---|---|---|---|---|
| 5,374,225 | A * | 12/1994 | Wilkinson | A63B 23/03533 | 482/29 |
| 5,584,779 | A | 12/1996 | Knecht et al. | | |
| 5,813,946 | A | 9/1998 | Lin et al. | | |
| 5,901,391 | A | 5/1999 | Kato | | |
| 6,145,142 | A | 11/2000 | Rechin et al. | | |
| 6,261,207 | B1 | 7/2001 | Publicover et al. | | |
| D462,103 | S | 8/2002 | Chen | | |
| 6,758,753 | B1 | 7/2004 | Nagata et al. | | |
| 7,060,000 | B2 | 6/2006 | Carlson | | |
| 7,297,089 | B2 | 11/2007 | Chen | | |
| 7,510,238 | B2 * | 3/2009 | McClintock | A47D 3/00 | 297/137 |
| 7,909,703 | B1 * | 3/2011 | Semrau | A63G 31/00 | 446/487 |
| 2004/0259689 | A1 | 12/2004 | Wilkins et al. | | |
| 2005/0043122 | A1 | 2/2005 | Publicover et al. | | |
| 2005/0209053 | A1 * | 9/2005 | Knox | A63B 5/11 | 482/29 |
| 2005/0264088 | A1 * | 12/2005 | Tadin | A63H 33/006 | 297/488 |
| 2006/0135320 | A1 * | 6/2006 | Chen | A63B 5/11 | 482/8 |
| 2010/0048356 | A1 * | 2/2010 | Hamilton | A63B 21/4037 | 482/4 |
| 2012/0295763 | A1 * | 11/2012 | Lin | A63B 5/11 | 482/4 |
| 2014/0038678 | A1 * | 2/2014 | Chen | A63B 69/0053 | 463/7 |
| 2015/0080186 | A1 * | 3/2015 | Carlin | A63B 5/11 | 482/27 |
| 2017/0144052 | A1 * | 5/2017 | Liang | A63B 5/11 | |
| 2017/0232288 | A1 * | 8/2017 | Ho | A63B 5/11 | 482/28 |
| 2017/0232355 | A1 * | 8/2017 | Healy | A47D 3/001 | 446/227 |
| 2017/0312644 | A1 * | 11/2017 | Meir | E04H 4/0056 | |
| 2017/0361155 | A1 * | 12/2017 | McGrane | A63B 24/0087 | |
| 2018/0311531 | A1 * | 11/2018 | Dalley | A63F 13/42 | |
| 2020/0238119 | A1 * | 7/2020 | Hagel | A63B 21/4033 | |
| 2021/0387034 | A1 * | 12/2021 | Hall | A63B 5/11 | |

FOREIGN PATENT DOCUMENTS

| | | | | |
|---|---|---|---|---|
| CN | 203208593 U | * | 9/2013 | |
| CN | 109011323 A | * | 12/2018 | |
| CZ | 2018503 A3 | * | 4/2020 | |
| DE | 202004016378 U1 | * | 1/2005 | A63B 5/11 |
| DE | 202017100525 | * | 6/2017 | |
| DE | 202017100525 U1 | * | 6/2017 | |
| DE | 202017003194 U1 | * | 8/2017 | |
| FR | 3040633 | * | 3/2017 | |
| FR | 3040633 A1 | * | 3/2017 | |
| GB | 2448716 A | * | 10/2008 | A63B 5/11 |
| KR | 101791558 B1 | * | 11/2017 | |
| KR | 102128524 B1 | * | 6/2020 | |
| KR | 102146074 B1 | * | 8/2020 | |

OTHER PUBLICATIONS

"Little Tikes Light-Up 3-food Trampoline with Folding Handle for Kids ages 3-6" available online at: shorturl.at/ekmV4 (available at least as early as Mar. 23, 2021) (10 pages).

"Sportspower 36" My 1st Trampoline with Handle" available online at: shorturl.at/otUW9 (available at least as early as Mar. 23, 2021) (3 pages).

"36" My First Trampoline with Mini Flash Litezone, Multiple Colors" available online at: shorturl.at/gps07 (available at least as early as Mar. 23, 2021) (9 pages).

"Skywalker Trampolines 36-Inch Square Language Learning Mini Bouncer" available online at: shorturl.at/ftuzL (available at least as early as Mar. 23, 2021) (7 pages).

"YouTube Jump-N-Count 36" Interactive Mini Bouncer" available online at: shorturl.at/tuFUZ (available at least as early as Mar. 23, 2021) (3 pages).

"Skywalker Trampolines Mini Trampoline with Enclosure Net" available online at: shorturl.at/himNO (available at least as early as Mar. 23, 2021) (10 pages).

* cited by examiner

INTERACTIVE ELECTRONIC TRAMPOLINE

CROSS-REFERENCE TO RELATED APPLICATIONS

This application claims the benefit of U.S. Provisional Patent Application No. 63/165,512 filed Mar. 24, 2021, which is expressly incorporated herein by reference and made a part hereof.

FEDERALLY SPONSORED RESEARCH OR DEVELOPMENT

Not Applicable.

TECHNICAL FIELD

The present subject matter relates to a trampoline, and more particularly, to an interactive electronic trampoline with a variety of play modes that provides outputs based on inputs, including an input from a sensor.

BACKGROUND

Electronic trampolines are known in the art. While such electronic trampolines according to the prior art provide a number of advantages, they nevertheless have certain limitations. The present disclosure seeks to overcome certain of those limitations and other drawbacks of the prior art, and to provide new features not heretofore available. A full discussion of the features and advantages of the present disclosure is deferred to the following detailed description, which proceeds with reference to the accompanying drawings.

SUMMARY

According to certain aspects of the present disclosure, the disclosed subject technology relates to an interactive electronic trampoline assembly.

The disclosed technology further relates to an interactive electronic trampoline assembly, comprising: a frame; a plurality of legs supporting the frame; a handlebar connected to the frame; a trampoline mat; a plurality of bias members securing the trampoline mat to the frame; and, a control module removably secured to the assembly adjacent the frame, the control module having a speaker, a power source, a controller, lights, control buttons, and a sensor to sense movement of the trampoline mat.

The disclosed technology further relates to an interactive electronic trampoline assembly, comprising: a frame; a plurality of legs supporting the frame; a trampoline mat; a plurality of bias members securing the trampoline mat to the frame; a skirt secured to the trampoline mat; a sensor connected to one of the skirt and the trampoline mat, the sensor sensing movement of the trampoline mat; and, a control module connected to the trampoline assembly, the control module having a controller electrically connected to the sensor.

The disclosed technology further relates to an interactive electronic trampoline assembly, comprising: a frame; a plurality of legs supporting the frame; a trampoline mat; a plurality of bias members securing the trampoline mat to the frame; a skirt secured to the trampoline mat and extending over the bias members; a sensor operably connected to the trampoline mat to sense movement of the trampoline mat; a control module connected to the trampoline assembly, the control module having a controller electrically connected to the sensor.

The disclosed technology further relates to an interactive electronic trampoline assembly having a skirt over the bias members, a portion of the skirt being secured to the trampoline mat.

The disclosed technology further relates to an interactive electronic trampoline assembly, wherein the control module is secured to the skirt over the bias members.

The disclosed technology further relates to an interactive electronic trampoline assembly having a hinge to fold the frame in half.

The disclosed technology further relates to an interactive electronic trampoline assembly, wherein the sensor is one of a tilt switch and a vibration switch to detect movement of the trampoline mat.

The disclosed technology further relates to an interactive electronic trampoline assembly, wherein a first surface of the trampoline mat has a variety of shapes and colors thereon.

The disclosed technology further relates to an interactive electronic trampoline assembly having a plurality of capacitive touch sensors connected to a second surface of the trampoline mat.

The disclosed technology further relates to an interactive electronic trampoline assembly having a handlebar connected to the frame.

The disclosed technology further relates to an interactive electronic trampoline assembly, wherein the handlebar is pivotally connected to the frame.

The disclosed technology further relates to an interactive electronic trampoline assembly, wherein the control module is removably connected to the trampoline assembly.

The disclosed technology further relates to an interactive electronic trampoline assembly, wherein the sensor is housed within the control module.

The disclosed technology further relates to an interactive electronic trampoline assembly, wherein the control module has a speaker, a power source, lights, and control buttons.

The disclosed technology further relates to an interactive electronic trampoline assembly, wherein the control module is removably secured to the skirt, and wherein the sensor is housed within the control module.

It is understood that other embodiments and configurations of the subject technology will become readily apparent to those skilled in the art from the following detailed description, wherein various configurations of the subject technology are shown and described by way of illustration. As will be realized, the subject technology is capable of other and different configurations and its several details are capable of modification in various other respects, all without departing from the scope of the subject technology. Accordingly, the drawings and detailed description are to be regarded as illustrative in nature and not as restrictive.

BRIEF DESCRIPTION OF THE DRAWINGS

To understand the present disclosure, it will now be described by way of example, with reference to the accompanying drawings in which embodiments of the disclosures are illustrated and, together with the descriptions below are incorporated in and constitute a part of this specification, and serve to explain the principles of the disclosure. In the drawings.

Figure 1:
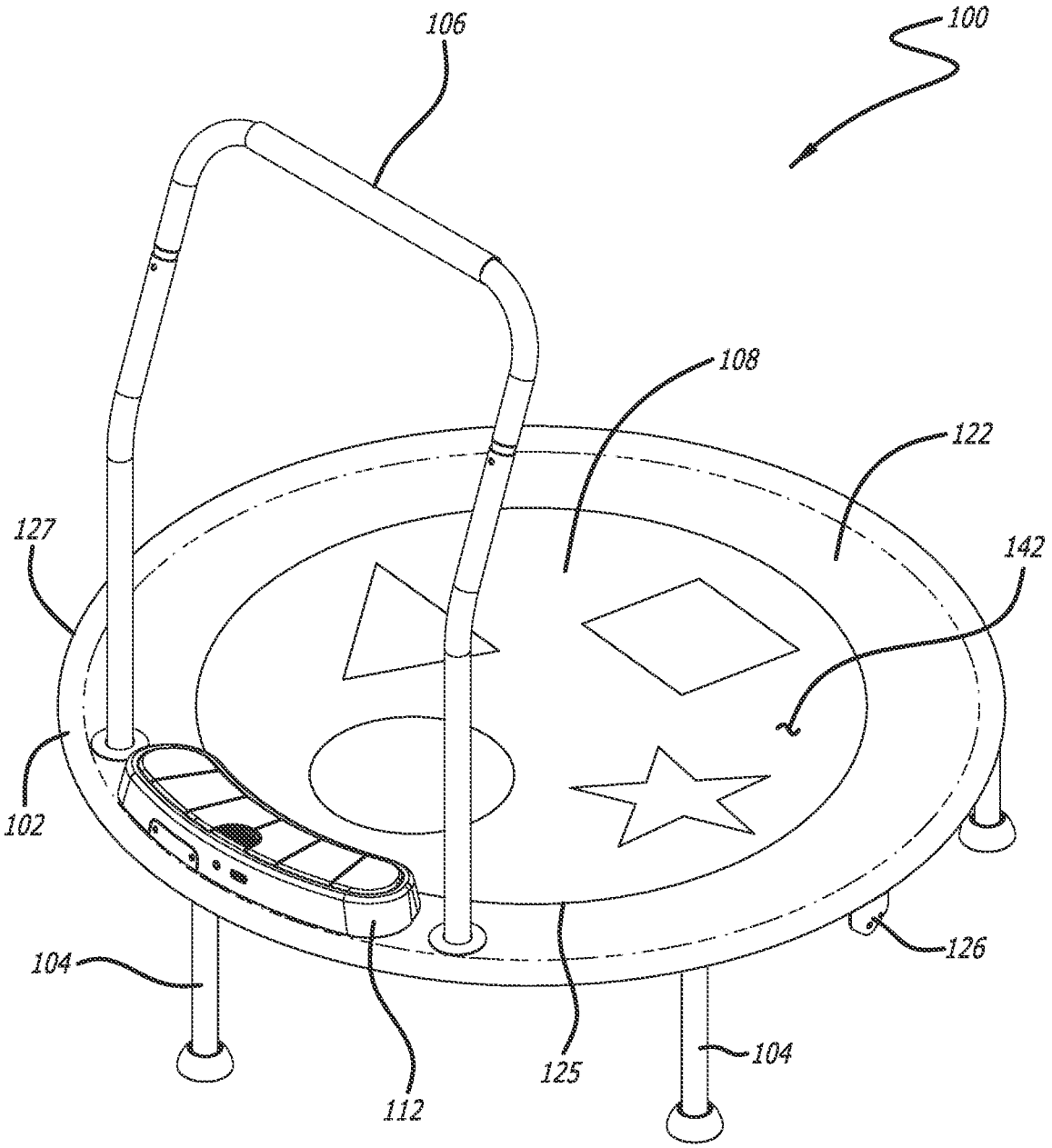
FIG. 1 is a front perspective view of an interactive electronic trampoline according to the present disclosure.

In one or more implementations, not all of the depicted components in each figure may be required, and one or more implementations may include additional components not shown in a figure. Variations in the arrangement and type of the components may be made without departing from the scope of the subject disclosure. Additional components, different components, or fewer components may be utilized within the scope of the subject disclosure.

DETAILED DESCRIPTION

While this disclosure is susceptible of embodiments in many different forms, there is shown in the drawings and will herein be described in detail preferred embodiments with the understanding that the present disclosure is to be considered as an exemplification of the principles of the disclosure and is not intended to limit the broad aspect of the disclosure to the embodiments illustrated. It should be noted that the features illustrated in the drawings are not necessarily drawn to scale, and features of one embodiment may be employed with other embodiments as one of ordinary skill in the relevant art would recognize, even if not explicitly stated herein. Further, descriptions of well-known components and processing techniques may be omitted so as to not unnecessarily obscure the embodiments of the present disclosure. The examples used herein are intended merely to facilitate an understanding of ways in which the present disclosure may be practiced and to further enable those of ordinary skill in the art to practice the embodiments of the present disclosure. Accordingly, the examples and embodiments herein should not be construed as limiting the scope of the present disclosure, which is defined solely by the appended claims and applicable law.

Generally, this disclosure describes several embodiments of interactive electronic trampolines that are arrangeable in a variety of different orientations.

Figure 2:
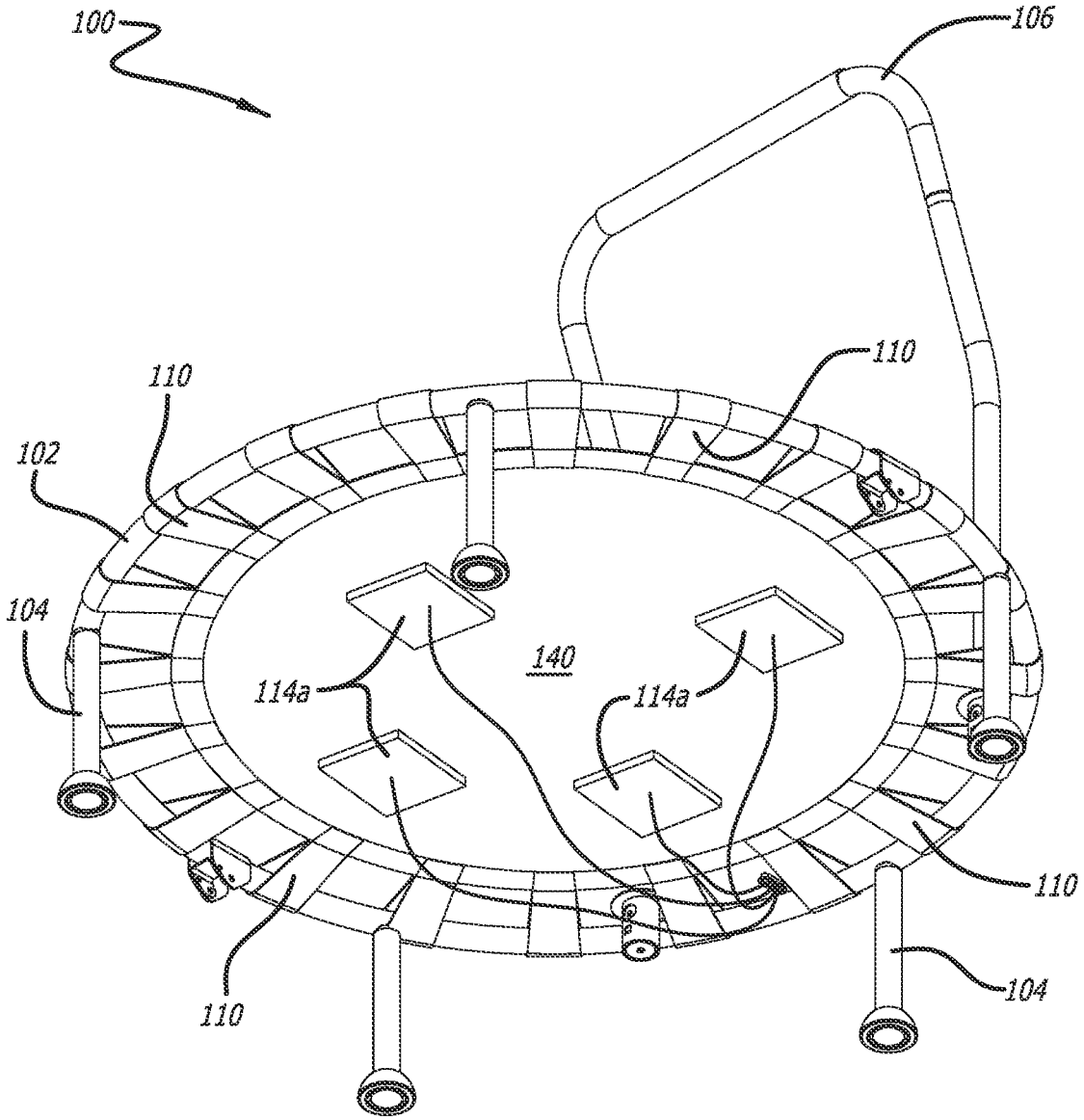
FIG. 2 is a bottom perspective view of the interactive electronic trampoline according to the present disclosure, with the skirt removed to show the bias members.
Figure 3:
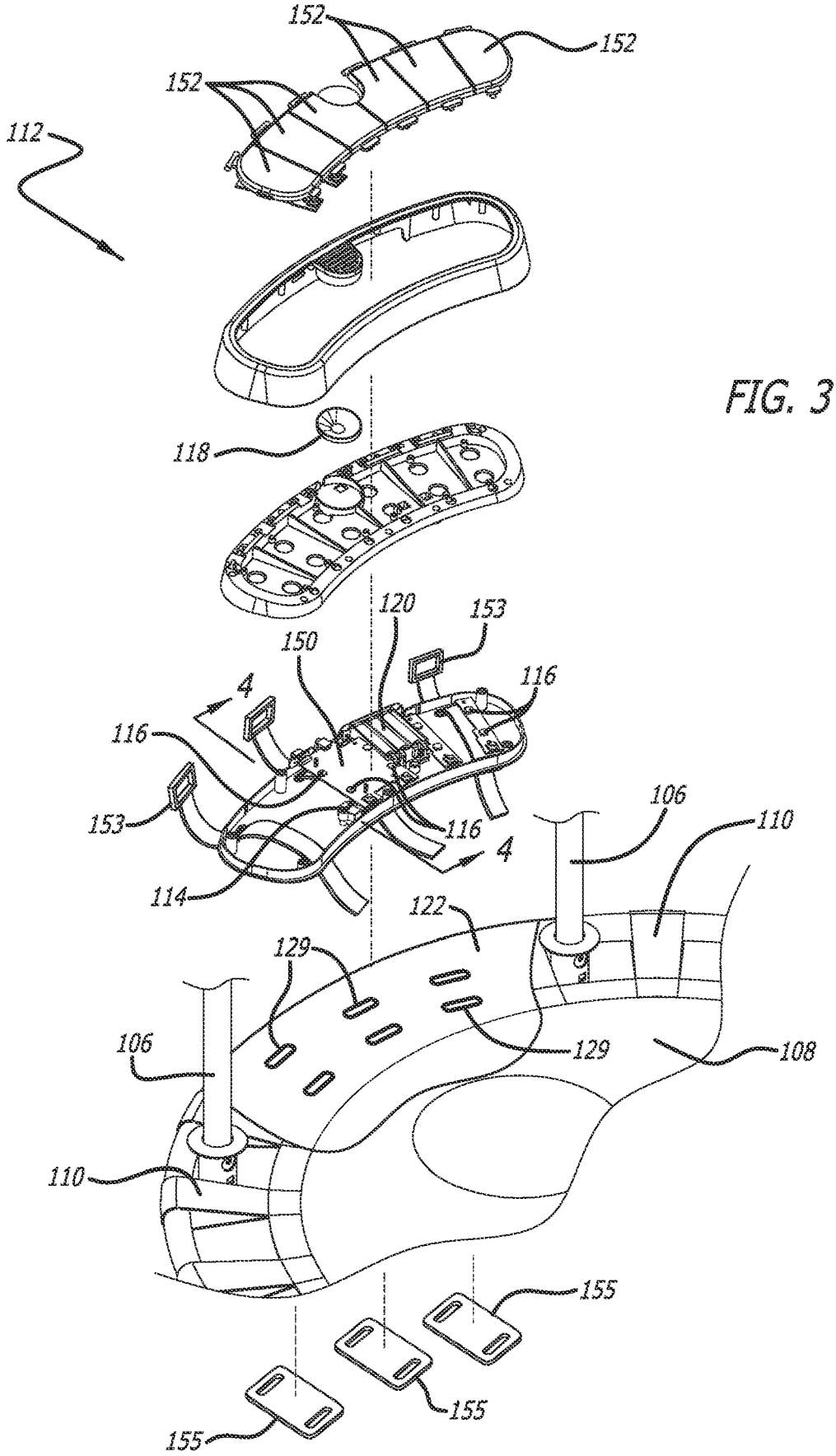
FIG. 3 is an exploded view of a control module for the interactive electronic trampoline according to the present disclosure.

Referring now to the figures, and initially to FIGS. 1-3, there is shown an embodiment of an interactive electronic trampoline 100. In one embodiment, the interactive electronic trampoline 100 generally comprises a frame 102, a plurality of legs 104 supporting the frame 102, a handlebar 106, a trampoline mat 108, a plurality of bias members 110, a control module 112, at least one sensor 114 to sense movement of the trampoline mat 108, lights 116, a speaker 118, and a power source 120. Additionally, in different embodiments the interactive electronic trampoline 100 may also have a skirt 122 and a skirt sidewall 124. The skirt 122 generally covers the bias members 110 and may have a cushiony properties.

As shown in FIGS. 1 and 2, the frame 102 generally supports the trampoline mat 108 via a plurality of bias members 110. The frame 102 may have hinges 126 to allow the frame 102 to fold for storage and transport. In one embodiment, the frame 102 is circular in shape, however, the frame 102 may be configured in alternate shapes, such as, for example, a rectangle, square, oval, or other polygon. The legs 104 are preferably connected to the frame 102 to support the frame 102 off the floor. The legs 104 may be fixedly or removably secured to the frame 102.

The bias members 110 may be springs or other stretch bands, such as shown in FIG. 2. The bias members 110 connect and secure the trampoline mat 108 to the frame 102 and generally allow the trampoline mat 108 to flex with respect to the frame 102 for bouncing thereon. In one embodiment, the bias members 110 are covered by the skirt 122, as shown in FIGS. 2, 3 and 5.

Figure 8:
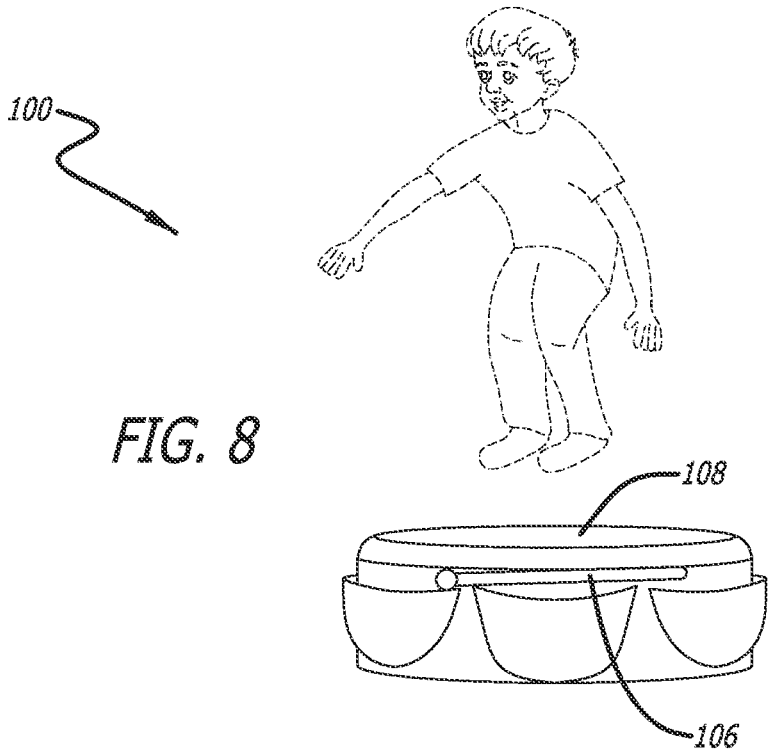
FIG. 8 is a side elevation view of another configuration of the interactive electronic trampoline of FIG. 5.

Referring to FIGS. 1-2 and 5-8, the interactive electronic trampoline 100 may have a handlebar 106 that the user may hold on to for support as they bounce on the trampoline mat 108. In one embodiment, as shown in the FIGS. 1-3, the handlebar 106 may be connected to the frame 102 in a fixed position, but it also may be removable for storage. In another embodiment, as shown in FIGS. 5-8, the handlebar 106 may be pivotally connected to the frame 102 and have multiple locking positions as shown in FIGS. 5-8 to accommodate different user heights and ages, including pivoting flat with the frame for storage and transport as shown in FIG. 8. Additionally, the handlebar 106 may have telescoping arms to allow for increasing and decreasing the height of the handlebar 106 for the user. In one embodiment, the handlebar 106 may be at least partially covered with a material, such as a safety foam.

As explained above, and best shown in FIGS. 1, 3 and 4, the interactive electronic trampoline 100 may have a skirt 122. The skirt 122 preferably rests on top of the bias members 110 to protect the user from the bias members 110. In one embodiment, the inside 125 of the skirt 122 may be connected to the trampoline mat 108, such as optionally at a circumference of the trampoline mat 108, including via sewing, and the outside 127 of the skirt 122 can be secured around the trampoline frame 102 with elastic, a cord, Velcro, etc. or by other means. In one embodiment, as explained herein, the skirt 122 has openings 129 to secure the control module 112 thereto.

Figure 5:
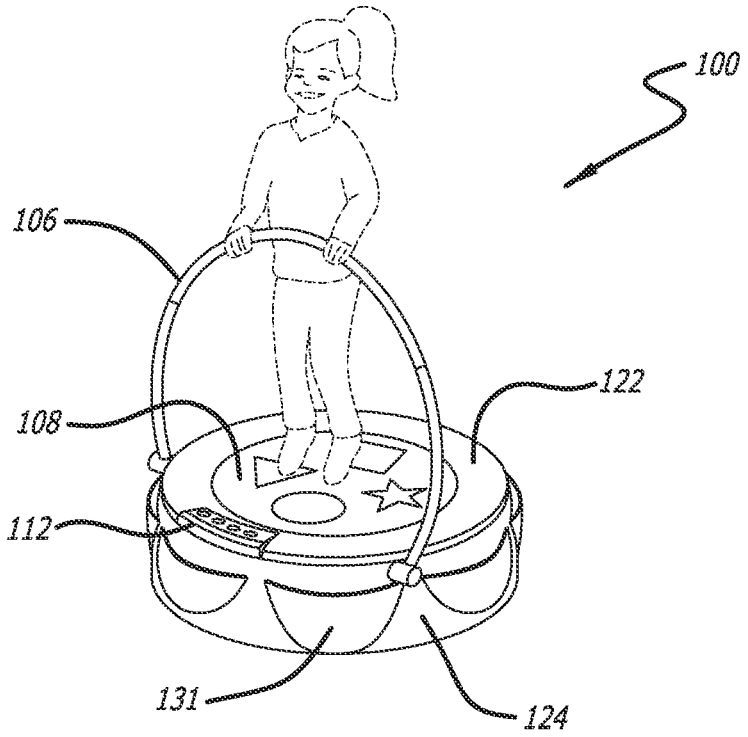
FIG. 5 is a front perspective view of an interactive electronic trampoline according to the present disclosure.
Figure 6:
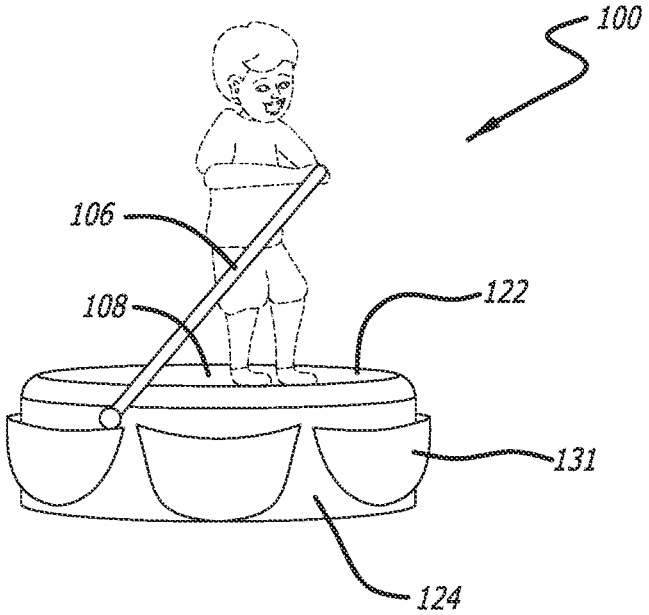
FIG. 6 is a side elevation view of one configuration of the interactive electronic trampoline of FIG. 5.
Figure 7:
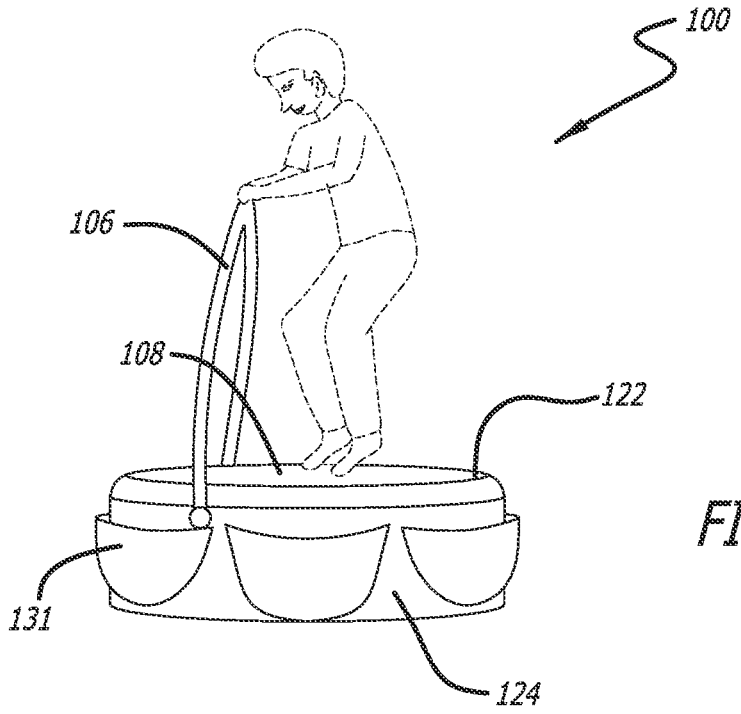
FIG. 7 is a side elevation view of another configuration of the interactive electronic trampoline of FIG. 5.

As shown in FIGS. 5-8, the skirt sidewall 124 may be connected to the frame 102 or to the skirt 122 and extend between the frame 102 and the ground. The skirt sidewall 124 may include pockets 131 for users to store items therein. Additionally, the skirt sidewall 124 and the trampoline mat 108 may have graphics and colors printed thereon. For example, as shown in FIGS. 1 and 5, the trampoline mat 108 has four different shapes, each of a different color, and each with a different number, for use with different play modes of the interactive electronic trampoline 100. Other accessories, such as a tent, may be added to the frame 102.

In one embodiment, the interactive electronic trampoline 100 also has several inputs, such as at least one sensor 114 and at least one control button 152, and several outputs, such as lights 116 and a speaker 118. Preferably, the interactive electronic trampoline 100 also has a power source 120, such as batteries or an A/C input as shown in FIG. 3.

Figure 4:
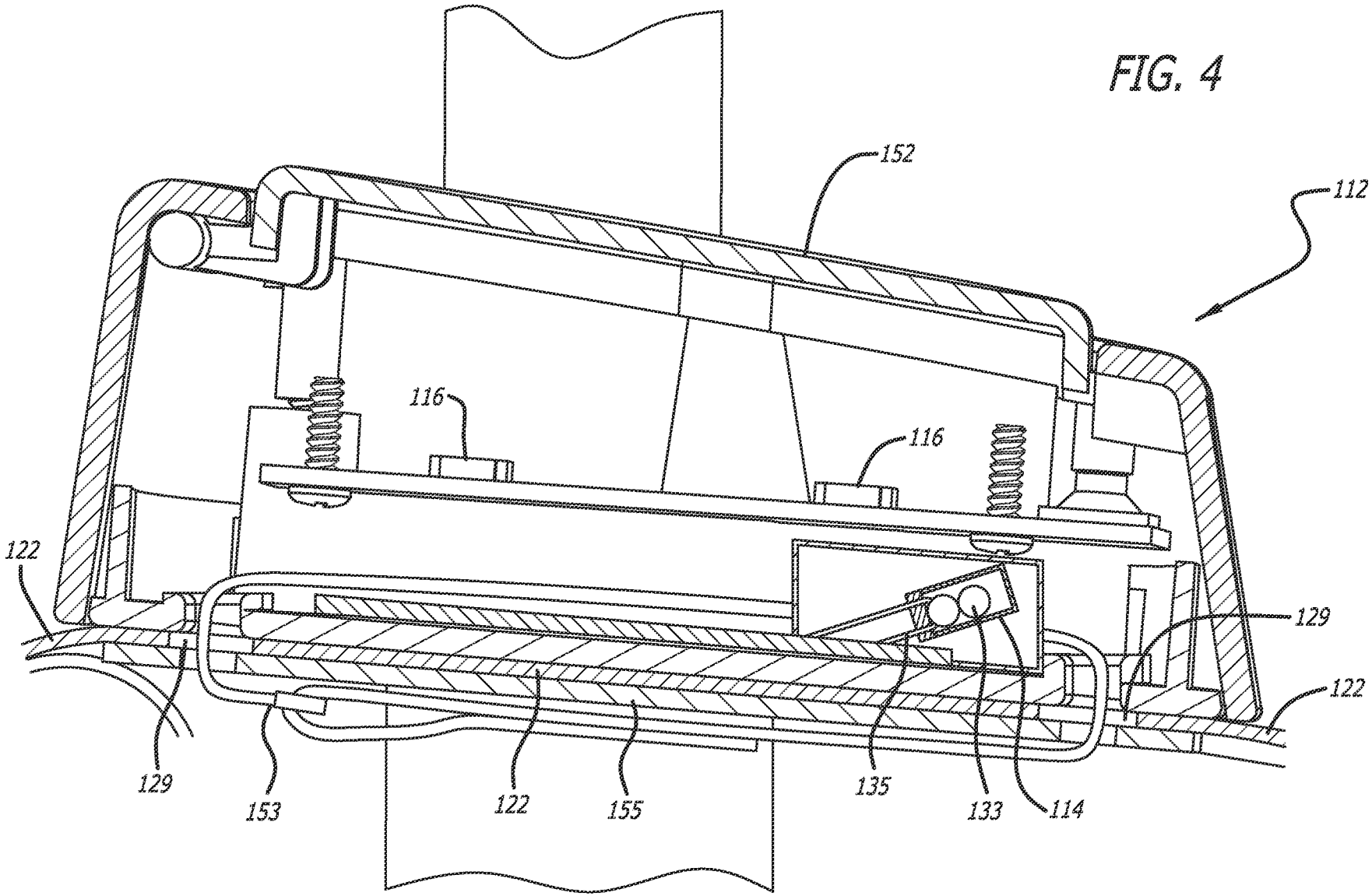
FIG. 4 is a cross sectional view about line 4-4 of the control module in FIG. 3 for the interactive electronic trampoline according to the present disclosure.

In one embodiment, the sensor 114 is a tilt switch 114 that is housed within the control module 112, as shown in FIGS. 3 and 4, to sense movement of the trampoline mat 108. In one embodiment, the tilt switch 114 comprises a mercury switch that uses a metal ball 133 or balls instead of mercury.

The balls 133 move from a closed or default position as shown in FIG. 4 where they contact one or more pins 135 within the tilt switch 114 when a child is not bouncing on the trampoline mat 108, to an open position where the balls 133 do not contact the pin 135 when a child bounces on the trampoline mat 108. In one embodiment, the controller 150, which is typically a motherboard or CPU/PCB, looks for the state of the sensor 114 only going from "closed" to "open" to eliminate the controller 150 from thinking there were two bounces. When the balls 133 return from the default "closed" position after a bounce the sensor 114 sends a signal to the controller 150 in the control module 112. Another type of sensor 114 is a vibration sensor or vibration switch 114, which can also be used to detect the presence of a bouncing action on the trampoline mat 108. The vibration or tilt switch may be placed either connected to the frame 102, sewn into the bounce mat 108, skirt 122, bias members 110, or integrated into the control module 112, among other locations. Additionally, an accelerometer may be utilized to detect bounces and integrated into the interactive electronic trampoline 100 similar to the vibration or tilt switch 114. In a preferred embodiment, the switch 114 is generally centered in the control module 112, and positioned as close to the trampoline mat 108 as possible and oriented radially toward a center of the trampoline mat 108. This may allow for the most amount of travel/angle change for the switch 114 to activate even with a softer bounce.

Another type of sensor 114 that may be included with the interactive electronic trampoline 100, in place of or in addition to one or more tilt switches 114 or vibration switches 114, is one or more capacitive touch sensors 114*a* using capacitive touch technology to sense the location of the user, such as the user's foot, hand, knee, etc. on the trampoline mat 108. As shown in FIG. 2, the capacitive touch sensors 114*a* may be made of a conductive knit fabric that is stretchable and easy to sew to the second or bottom surface 140 of the trampoline mat 108, however, any conductive material/sensor and any fastening mechanism may be utilized. Additionally, the capacitive touch sensors 114*a* may be any shape and size that performs the required function. The capacitive touch sensors 114*a* are electrically connected to the controller 150 in the control module 112 via wires. In a preferred embodiment, the capacitive touch sensors 114*a* are placed on the second or bottom surface 140 of the trampoline mat 108 directly below the screen printed graphics on the top surface 142 to indicate to the user where the inputs are located. In alternate embodiments, one or more capacitive touch sensors 114*a* may be placed in areas of the trampoline mat 108 where there are no graphics to allow for detecting inputs in those areas.

The control module 112 for the interactive electronic trampoline 100 is shown in FIGS. 1, 3 and 4. In one embodiment, the control module 112 is plastic housing mounted to the interactive electronic trampoline 100 that is essentially the "brains" that is used to turn the interactive electronic trampoline 100 on and off, adjust the volume of the speaker(s) 118, and to select the play mode for the interactive electronic trampoline 100. The control module 112 may have control or selector buttons 152 as shown in FIGS. 1 and 3. A controller 150 to receive inputs and provide controlled outputs, as well as a power source 120 such as batteries 120 to power the control module 112, and other components may also be housed in the control module 112. Further, lights 116 may be provided in the control module 112, such as at least one RGB LED light 116 below each selector button 152 (although not shown under each button 152 in FIG. 3), and the selector buttons 152 may preferably be designed to allow the lights 116 to shine through when illuminated. The lights 116 preferably light up during use. In an alternate embodiment, the lights 116 comprise a light strip 116 that is either connected to the frame 102 or the trampoline mat 108. Further, in another alternate embodiment, additional lights comprise addressable RGB LED lights that are sewn into the top surface 142 of the trampoline mat 108. Further, the lights 116 could illuminate the capacitive touch shapes, graphics, or other items. In an alternate embodiment, the capacitive touch sensors 114 may include lights 116. Additionally, as explained herein, and shown in FIG. 4, the sensor 114 may be housed within the control module 112. Accordingly, the sensor 114 is operably connected to the trampoline mat 108.

While not shown, the control module 112 may have a display, such as an LCD display, to display the play mode setting as well as other aspects of the play (e.g., display the number of bounces during a period of time).

The speaker(s) 118 generally play sounds or provide instructions or encouragement according to play mode and sensor 114 input and control by the controller 150. In one embodiment the speakers 118 are integrated into the control module 112 as shown in FIG. 3, however, in an alternate embodiment the speakers 118 are connected to the frame 102.

In one embodiment, as shown in FIGS. 1 and 3, the control module 112 may be secured to the assembly 100 adjacent the frame 102, and in another embodiment the control module 112 is removably secured to the assembly 100. In a preferred embodiment, the control module 112 is secured to the skirt 122 over the bias members 110. The skirt 122 has a plurality of openings 129 as best shown in FIG. 3. Straps 153 extend through the control module 112 and the openings 129 in the skirt 122 to removably secure the control module 112 to the skirt 122. Rigid templates 155 may be used under the skirt 122 to assist in securing the control module 112 to the skirt 122. Alternately, the control module 112 may be mounted to the handlebar 106 or sewn into the trampoline mat 108.

The various inputs and outputs for the interactive electronic trampoline 100 allow for multiple/infinite ways for a user to interact with the interactive electronic trampoline 100 depending on the programming of the controller 150 and the input and output devices provided. The control module 112 allows the user to select what type of "play" or "mode" they would like to use, and processes the inputs to provide the appropriate outputs depending on the selected mode. Through programming logic, the outputs may behave or react differently to the various inputs. Different modes of play include: "open ended play", "bounce around", "how many times can you bounce in X seconds?", "Bounce and Play a Song", "Simon says", "freeze dance", "dance lesson", "counting", and many more. In one embodiment, when the user selects a new mode/game, the speaker or display will identify the mode/game for the user.

Open Ended Play: In one embodiment, for every bounce detected, all of the lights 116 under the selector buttons 152 will light up and change color and be the same color rotating between Red, Orange, Yellow, Green, Cyan, Blue, and Purple. Additionally, the lights 116 may changes color, and fade out after each bounce on the trampoline mat 108 by the user. The interactive electronic trampoline 100 may provide sounds for each bounce.

Bounce Around: In one embodiment, for every bounce detected by the sensor 114 of the trampoline mat 108, each of the selector buttons 152 will change color individually to a random color (Red, Orange, Yellow, Green, Cyan, Blue, or Purple) and a sound will play.

How many times can you bounce in X seconds?: In one embodiment, the interactive electronic trampoline 100 will play music and the user will bounce as quickly as they can in a certain period of time. The sensor(s) 114 detect how many bounces the user performed, and once the X seconds of music is finished, the interactive electronic trampoline 100 may either indicate the number of bounces in X seconds visually on the control module 112, audibly with sound output via the speaker 118, or another ways such as by illuminating a specific number of lights 116. Additionally, while bouncing, the lights 116 will sequentially illuminate and change color as each bounce is detected. For example, in one embodiment one section of lights 116 are yellow after first bounce, a subsequent section of lights 116 are green after second bounce, etc. Once all of the selector buttons 152 are illuminated, the lights 116 will continue again either with or without turning off the other lights 116 previously lit, using different colors to indicate incremental change due to a new bounce detection. The interactive electronic trampoline 100 may also ask the user to bounce and will identify the number after each bounce to assist children in learning to count. The interactive electronic trampoline 100 may store the highest score and identify when a new high score is achieved.

Bounce and Play a Song: In one embodiment, for every bounce detected by the sensor 114 a note from a song will play. For each sequential bounce, the next note in the song will play. After the song is complete, it will continue to the next song. Additionally, the lights 116 under the control buttons 152 will light up for each bounce in a rainbow of colors sequentially.

Simon Says: In this game mode the speaker 118 will say a command based, such as to touch one of the graphics on the top surface 142 of the trampoline mat 108. Graphics may be different shapes, colors, numbers, letters, animals, etc. and/or combinations thereof. For example, the interactive electronic trampoline 100 may say "Step on Number 1," "Step on the Circle," etc. Some or all lights 116 illuminate to the color of the shape/number/letter/animal covering the sensor 114 when the correct input is stepped on and then the lights fades out, turn off, or flash. The interactive electronic trampoline 100 may also alert the user audibly when the user successfully achieves the command, they will receive an accolade like "great job!"

Freeze Dance: In this game mode, the interactive electronic trampoline 100 will provide a "Go" prompt, and the lights 116 will illuminate with fun patterns and colors while music plays for a period of time. After the period of time is complete, all lights turn red and the speaker says "Freeze". After another period of time, the lights 116 turn green as the speaker 118 says "Go". The lights 116 will resume to illuminating with fun patterns and colors while the music continues. This may repeat until a programmed time has passed or the user changes modes or turns the control module 112 off. The program may or may not use inputs to detect if the user stopped moving or "froze" during the freeze period. If the program does detect inputs, the speaker 118 may say "I think you moved" or "you're not frozen!" The program also may encourage the user to bounce/dance during the "go" period.

Additional exemplar modes of play may include: (a) the display on the control module 112 may display the number of bounces with no time limit; (b) the speaker 118 may count along with the user as they bounce, counting out loud per bounce; (c) a memory game may be played where the control module 112 provides a growing list of tasks to complete in series and the user has to match the list in play.

If there are no bounces detected for a given period of time, such as 2 minutes, the control module 112 will ask the user if they want to continue playing the game by pressing a given button. If no bounces or button presses are detected within a period of time after that, such as 5 minutes, the control module 112 will go to "sleep mode" to preserve battery life. When in sleep mode, a bounce or a button press will restart the control module 112.

Additionally, the interactive electronic trampoline 100 may allow a user to connect, either view Bluetooth or an auxiliary input, to the user's music device to play music through the speakers 118 of the interactive electronic trampoline 100. The lights 116 may illuminate to react to the music that is streamed/connected to the module or to the trampoline's inputs. Further, the interactive electronic trampoline 100 may have internet connectivity to allow a user to play with remote friends, and to download new games. The interactive electronic trampoline 100 may also have a feature to go to sleep automatically after X minutes of no input detection The embodiments detailed hereinabove may be combined in full or in part, with any alternative embodiments described.

A reference to an element in the singular is not intended to mean "one and only one" unless specifically stated, but rather "one or more." The term "some" refers to one or more. Underlined and/or italicized headings and subheadings are used for convenience only, do not limit the subject technology, and are not referred to in connection with the interpretation of the description of the subject technology. Relational terms such as first and second and the like may be used to distinguish one entity or action from another without necessarily requiring or implying any actual such relationship or order between such entities or actions. All structural and functional equivalents to the elements of the various configurations described throughout this disclosure that are known or later come to be known to those of ordinary skill in the art are expressly incorporated herein by reference and intended to be encompassed by the subject technology. Moreover, nothing disclosed herein is intended to be dedicated to the public regardless of whether such disclosure is explicitly recited in the above description.

Numerous modifications to the present disclosure will be apparent to those skilled in the art in view of the foregoing description. Preferred embodiments of this disclosure are described herein, including the best mode known to the inventors for carrying out the disclosure. It should be understood that the illustrated embodiments are exemplary only, and should not be taken as limiting the scope of the disclosure.

Several alternative embodiments and examples have been described and illustrated herein. A person of ordinary skill in the art would appreciate the features of the individual embodiments, and the possible combinations and variations of the components. A person of ordinary skill in the art would further appreciate that any of the embodiments could be provided in any combination with the other embodiments disclosed herein. Additionally, the terms "first," "second," "third," and "fourth" as used herein are intended for illustrative purposes only and do not limit the embodiments in any way. Further, the term "plurality" as used herein indicates any number greater than one, either disjunctively or conjunctively, as necessary, up to an infinite number. Additionally, the term "having" as used herein in both the disclosure and claims, is utilized in an open-ended manner.

As used herein, the phrase "at least one of" preceding a series of items, with the terms "and" or "or" to separate any of the items, modifies the list as a whole, rather than each member of the list (i.e., each item). The phrase "at least one of" does not require selection of at least one item; rather, the phrase allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

To the extent that the term "include," "have," or the like is used in the description or the claims, such term is intended to be inclusive in a manner similar to the term "comprise" as "comprise" is interpreted when employed as a transitional word in a claim. Phrases such as an aspect, the aspect, another aspect, some aspects, one or more aspects, an implementation, the implementation, another implementation, some implementations, one or more implementations, an embodiment, the embodiment, another embodiment, some embodiments, one or more embodiments, a configuration, the configuration, another configuration, some configurations, one or more configurations, the subject technology, the disclosure, the present disclosure, other variations thereof and alike are for convenience and do not imply that a disclosure relating to such phrase(s) is essential to the subject technology or that such disclosure applies to all configurations of the subject technology. A disclosure relating to such phrase(s) may apply to all configurations, or one or more configurations. A disclosure relating to such phrase(s) may provide one or more examples. A phrase such as an aspect or some aspects may refer to one or more aspects and vice versa, and this applies similarly to other foregoing phrases.

A reference to an element in the singular is not intended to mean "one and only one" unless specifically stated, but rather "one or more." The term "some" refers to one or more. Underlined and/or italicized headings and subheadings are used for convenience only, do not limit the subject technology, and are not referred to in connection with the interpretation of the description of the subject technology. Relational terms such as first and second and the like may be used to distinguish one entity or action from another without necessarily requiring or implying any actual such relationship or order between such entities or actions. All structural and functional equivalents to the elements of the various configurations described throughout this disclosure that are known or later come to be known to those of ordinary skill in the art are expressly incorporated herein by reference and intended to be encompassed by the subject technology. Moreover, nothing disclosed herein is intended to be dedicated to the public regardless of whether such disclosure is explicitly recited in the above description. No claim element is to be construed under the provisions of 35 U.S.C. § 112, sixth paragraph, unless the element is expressly recited using the phrase "means for" or, in the case of a method claim, the element is recited using the phrase "step for."

While this specification contains many specifics, these should not be construed as limitations on the scope of what may be claimed, but rather as descriptions of particular implementations of the subject matter. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

The title, background, brief description of the drawings, abstract, and drawings are hereby incorporated into the disclosure and are provided as illustrative examples of the disclosure, not as restrictive descriptions. It is submitted with the understanding that they will not be used to limit the scope or meaning of the claims. In addition, in the detailed description, it can be seen that the description provides illustrative examples and the various features are grouped together in various implementations for the purpose of streamlining the disclosure. The method of disclosure is not to be interpreted as reflecting an intention that the claimed subject matter requires more features than are expressly recited in each claim. Rather, as the claims reflect, inventive subject matter lies in less than all features of a single disclosed configuration or operation. The claims are hereby incorporated into the detailed description, with each claim standing on its own as a separately claimed subject matter.

It will be understood that the present disclosure may be embodied in other specific forms without departing from the spirit or central characteristics thereof. The present examples and embodiments, therefore, are to be considered in all respects as illustrative and not restrictive, and the Claims are not to be limited to the details given herein. Accordingly, while the specific embodiments have been illustrated and described, numerous modifications come to mind without significantly departing from the spirit of the disclosure and the scope of protection is only limited by the scope of the accompanying Claims.

Further, the claims are not intended to be limited to the aspects described herein, but are to be accorded the full scope consistent with the language claims and to encompass all legal equivalents. Notwithstanding, none of the claims are intended to embrace subject matter that fails to satisfy the requirements of the applicable patent law, nor should they be interpreted in such a way.

What is claimed is:

1. An interactive electronic trampoline assembly, comprising: a frame;

a plurality of legs supporting the frame;

a handlebar connected to the frame;

a trampoline mat;

a plurality of bias members securing the trampoline mat to the frame;

a control module having a speaker, a power source, a controller, lights, control buttons, and a sensor to sense movement of the trampoline mat; and, a skirt over the bias members, wherein the skirt has a plurality of openings, and wherein the control module is configured to be removably secured to the skirt at the openings using straps.

2. The interactive electronic trampoline assembly of claim 1, further comprising a hinge to fold the frame in half.

3. The interactive electronic trampoline assembly of claim 1, wherein the sensor is one of a tilt switch and a vibration switch.

4. The interactive electronic trampoline assembly of claim 1, wherein a first surface of the trampoline mat has a variety of shapes and colors thereon.

5. The interactive electronic trampoline assembly of claim 1, further comprising a plurality of capacitive touch sensors connected to a second surface of the trampoline mat.

6. The interactive electronic trampoline assembly of claim 1, wherein the handlebar is pivotally connected to the frame.

7. An interactive electronic trampoline assembly, comprising: a frame;

a plurality of legs supporting the frame;

a trampoline mat;

a plurality of bias members securing the trampoline mat to the frame;

a skirt secured to the trampoline mat, the skirt having a top surface and a bottom surface;

a sensor connected to one of the skirt and the trampoline mat, the sensor sensing movement of the trampoline mat; and, a control module having a controller electrically connected to the sensor, wherein the control module is connected to the top surface of the skirt, and wherein the control module is removably secured to the skirt with a plurality of straps that pass through a plurality of openings in the skirt.

8. The interactive electronic trampoline assembly of claim 7, wherein the control module has a speaker, a power source, lights, and control buttons.

9. The interactive electronic trampoline assembly of claim 7, further comprising a handlebar connected to the frame.

10. An interactive electronic trampoline assembly, comprising: a frame;

a plurality of legs supporting the frame;

a trampoline mat;

a plurality of bias members securing the trampoline mat to the frame;

a skirt secured to the trampoline mat and extending over the bias members;

a sensor operably connected to the trampoline mat to sense movement of the trampoline mat;

a control module connected to the trampoline assembly, the control module having a controller electrically connected to the sensor; and a handlebar connected to the frame and comprising two vertical supports connected to a horizontal hand rail, wherein the control module is spaced between the two vertical supports of the handlebar, wherein the control module is connected to a top surface of the skirt, and wherein the control module is removably secured to the skirt with a plurality of straps that pass through a plurality of openings in the skirt.

11. The interactive electronic trampoline assembly of claim 10, wherein the sensor is housed within the control module.

12. The interactive electronic trampoline assembly of claim 10, wherein the sensor is a tilt switch or a vibration sensor.

13. The interactive electronic trampoline assembly of claim 10, wherein the sensor comprises a plurality of capacitive touch sensors connected to a bottom surface of the trampoline mat.

14. The interactive electronic trampoline assembly of claim 10, wherein the top surface of the trampoline mat has a variety of shapes and colors thereon.

15. The interactive electronic trampoline assembly of claim 10, wherein the control module has a speaker, a power source, lights, and control buttons.

* * * * *